US008814120B1

(12) United States Patent
Kleespie

(10) Patent No.: US 8,814,120 B1
(45) Date of Patent: Aug. 26, 2014

(54) FUEL TANK SUPPORT SYSTEM

(76) Inventor: Bruce Kleespie, Portage, WI (US)

( * ) Notice: Subject to any disclaimer, the term of this patent is extended or adjusted under 35 U.S.C. 154(b) by 562 days.

(21) Appl. No.: 12/752,041

(22) Filed: Mar. 31, 2010

(51) Int. Cl.

| | |
|---|---|
| ***A47B 91/00*** | (2006.01) |
| ***A47G 29/00*** | (2006.01) |
| ***B65D 19/00*** | (2006.01) |
| ***D01H 13/30*** | (2006.01) |

(52) U.S. Cl.
USPC . 248/346.01; 248/677; 248/678; 248/346.02; 248/903; 248/352; 248/146; 248/121; 248/637; 248/346.03; 248/346.5; 248/523; 248/519; 52/27; 52/299; 52/169.9; 52/292; 52/169.12; 108/57.31

(58) Field of Classification Search
USPC ..... 248/346.01, 677, 678, 346.02, 903, 248/352, 146, 121, 637, 346.03, 346.5, 523, 248/519; 52/27, 299, 169.9, 292, 169.12; 108/57.31
See application file for complete search history.

(56) References Cited

U.S. PATENT DOCUMENTS

| | | | | |
|---|---|---|---|---|
| 5,144,852 | A * | 9/1992 | Yokoyama | 74/473.36 |
| 6,219,981 | B1 * | 4/2001 | Bergelt | 52/294 |
| 6,910,668 | B2 * | 6/2005 | Henning | 248/346.02 |
| 7,104,524 | B1 * | 9/2006 | Hidding et al. | 254/88 |
| 7,726,620 | B1 * | 6/2010 | Kleespie | 248/346.01 |
| 7,779,764 | B2 * | 8/2010 | Naidu et al. | 108/57.26 |
| 7,779,765 | B2 * | 8/2010 | Donnell et al. | 108/57.26 |
| 7,918,429 | B1 * | 4/2011 | Kleespie | 248/346.01 |
| 2010/0207004 | A1 * | 8/2010 | Hermans et al. | 248/346.01 |

OTHER PUBLICATIONS

WB Sales, Inc., "Dandi Block", <retrieved from http://www.wbsales.net/dandi/dandi.asp Feb. 8, 2008>. Date of first publication is believed to be prior to Feb. 1, 2007.

* cited by examiner

*Primary Examiner* — Christopher Garft
(74) *Attorney, Agent, or Firm* — Neustel Law Offices

(57) ABSTRACT

A fuel tank support system for providing a lightweight yet strong structure for supporting propane tanks above a ground surface. The tank support generally includes an elongated support pad having a platform, a base plate connected to the support pad, and a plurality of internal supports connected between the support pad and the base plate. A plurality of pairs of upper retainer rings extends from an underside of the platform to define upper receiver slots, and a plurality of pairs of lower retainer rings extends from an upper side of the base plate to define lower receiver slots. An upper end of each of the internal supports is received by the upper receiver slots and a lower end of each of the internal supports is received by the lower receiver slots. Handles, bottom grooves, and internal ribbing are also used with the tank support.

20 Claims, 10 Drawing Sheets

FUEL TANK SUPPORT SYSTEM

CROSS REFERENCE TO RELATED APPLICATIONS

Not applicable to this application.

STATEMENT REGARDING FEDERALLY SPONSORED RESEARCH OR DEVELOPMENT

Not applicable to this application.

BACKGROUND OF THE INVENTION

1. Field of the Invention

The present invention relates generally support blocks and more specifically it relates to a fuel tank support system for efficiently providing a lightweight yet strong support block for use in various areas, such as for supporting propane tanks above a ground surface.

2. Description of the Related Art

Any discussion of the related art throughout the specification should in no way be considered as an admission that such related art is widely known or forms part of common general knowledge in the field.

Propane tank supports have been in use for years and are generally utilized to support a propane tank above the ground. Propane tanks are supported above the ground for various reasons, such as to allow the propane tank to be painted, to allow maintenance upon the tank or to simply support the tank above the ground and prevent the tank from sinking within the ground or damaging the ground below.

Generally, concrete blocks are utilized to support the legs of a propane tank to support the tank above the ground. However, concrete blocks can be difficult to utilize for various reasons, such as but not limited to difficulty in moving around because of their weight, cumbersome to carry and fragile in that the concrete blocks may often crack if dropped upon a hard surface. Because of the inherent problems with the related art, there is a need for a new and improved propane tank support system for efficiently supporting a propane tank above the ground. Because of the inherent problems with the related art, there is a need for a new and improved fuel tank support system for efficiently providing a lightweight yet strong support block for use in various areas, such as for supporting propane tanks above a ground surface.

BRIEF SUMMARY OF THE INVENTION

A system for efficiently providing a lightweight yet strong support block for use in various areas, such as for supporting propane tanks above a ground surface. The invention generally relates to a support block which includes an elongated support pad having a platform, a base plate connected to the support pad, and a plurality of internal supports connected between the support pad and the base plate. A plurality of pairs of upper retainer rings extends from an underside of the platform to define upper receiver slots, and a plurality of pairs of lower retainer rings extends from an upper side of the base plate to define lower receiver slots. An upper end of each of the internal supports is received by the upper receiver slots and a lower end of each of the internal supports is received by the lower receiver slots. Handles, bottom grooves, and internal ribbing are also used with the tank support.

There has thus been outlined, rather broadly, some of the features of the invention in order that the detailed description thereof may be better understood, and in order that the present contribution to the art may be better appreciated. There are additional features of the invention that will be described hereinafter and that will form the subject matter of the claims appended hereto. In this respect, before explaining at least one embodiment of the invention in detail, it is to be understood that the invention is not limited in its application to the details of construction or to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

A. Overview

Figure 1:
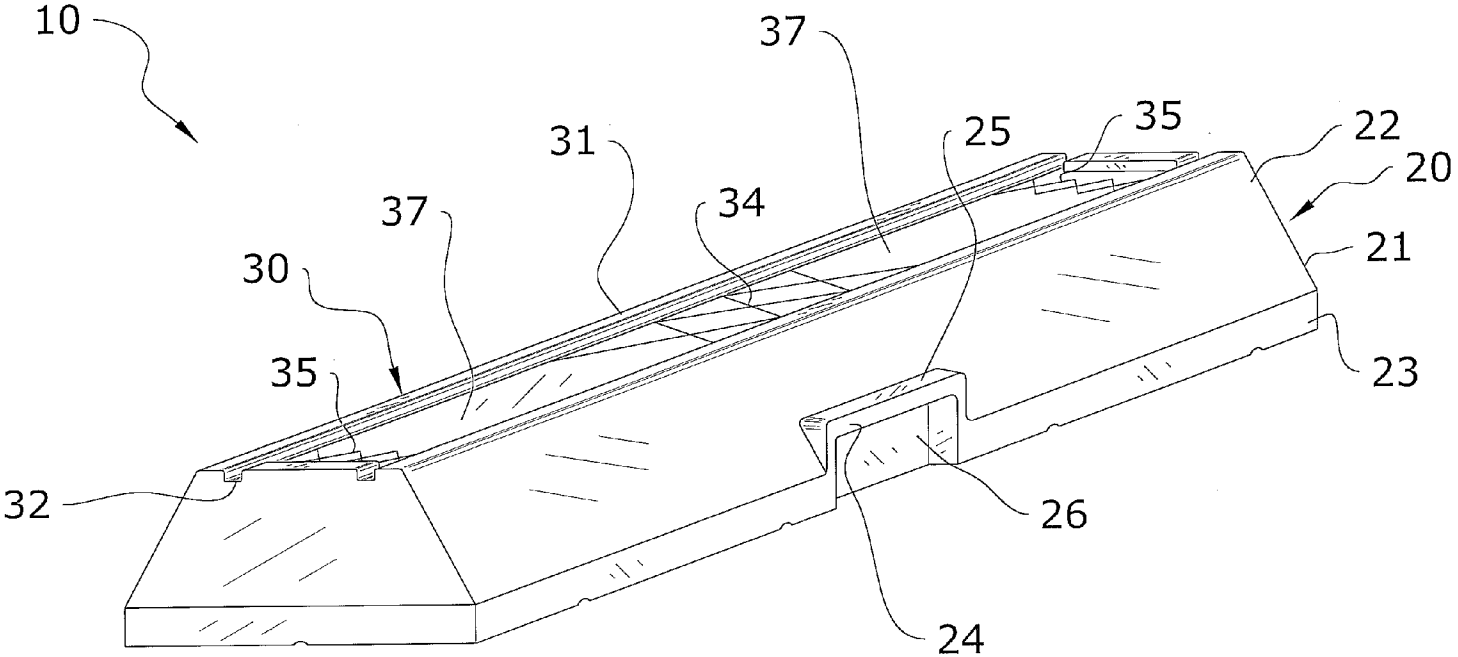
FIG. 1 is an upper perspective view of the present invention.
Figure 2:
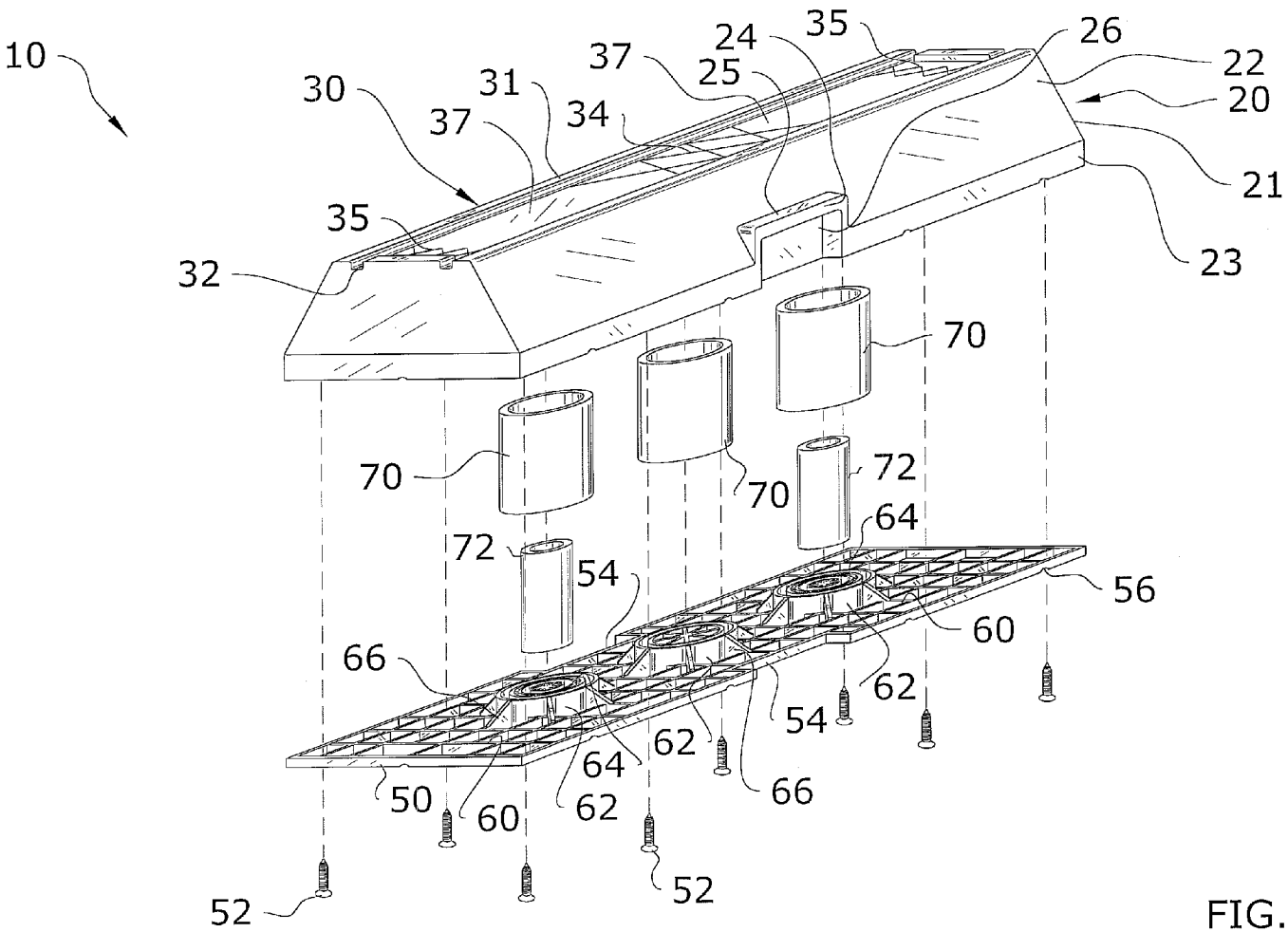
FIG. 2 is an exploded upper perspective view of the present invention.
Figure 3:
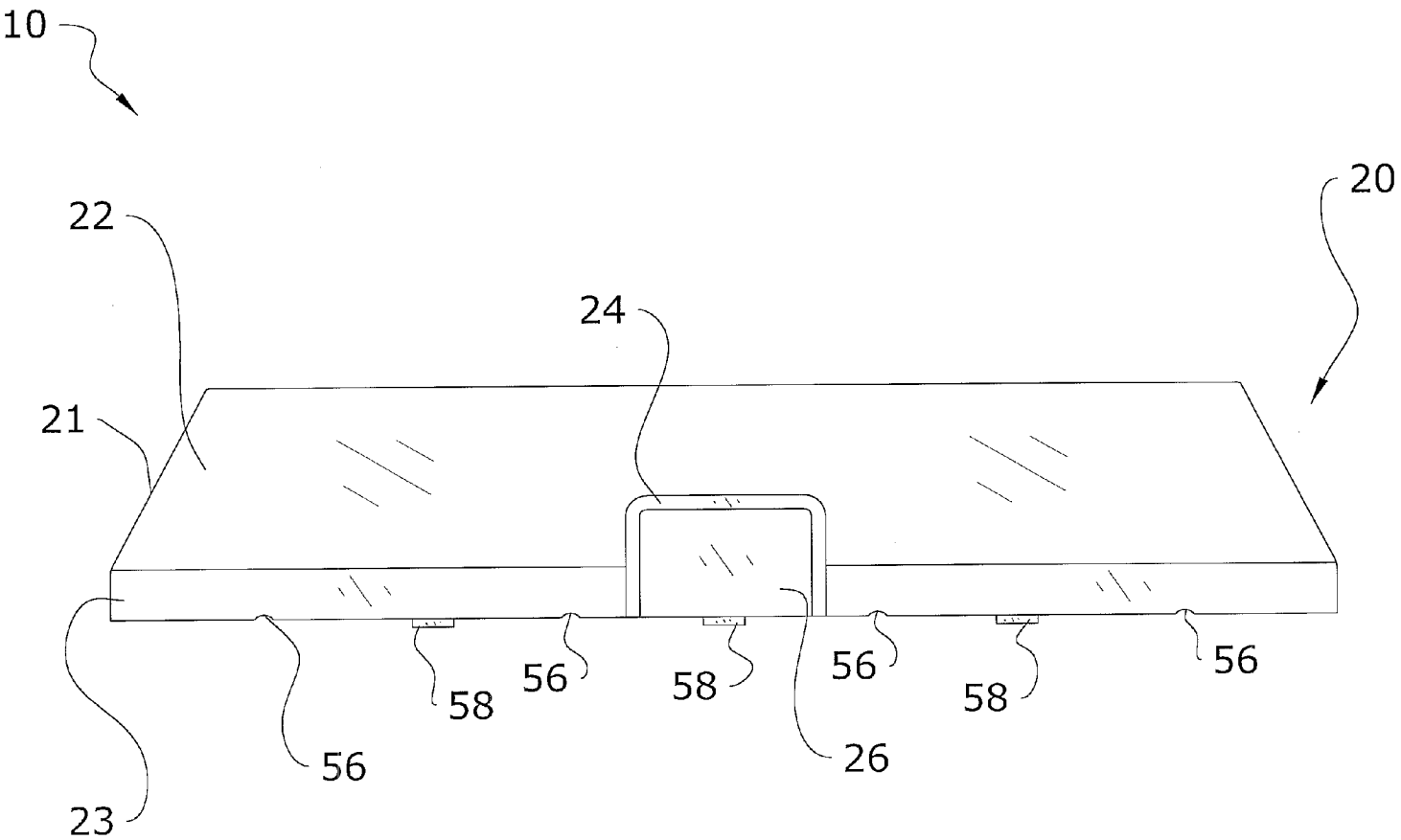
FIG. 3 is a side view of the present invention.
Figure 4:
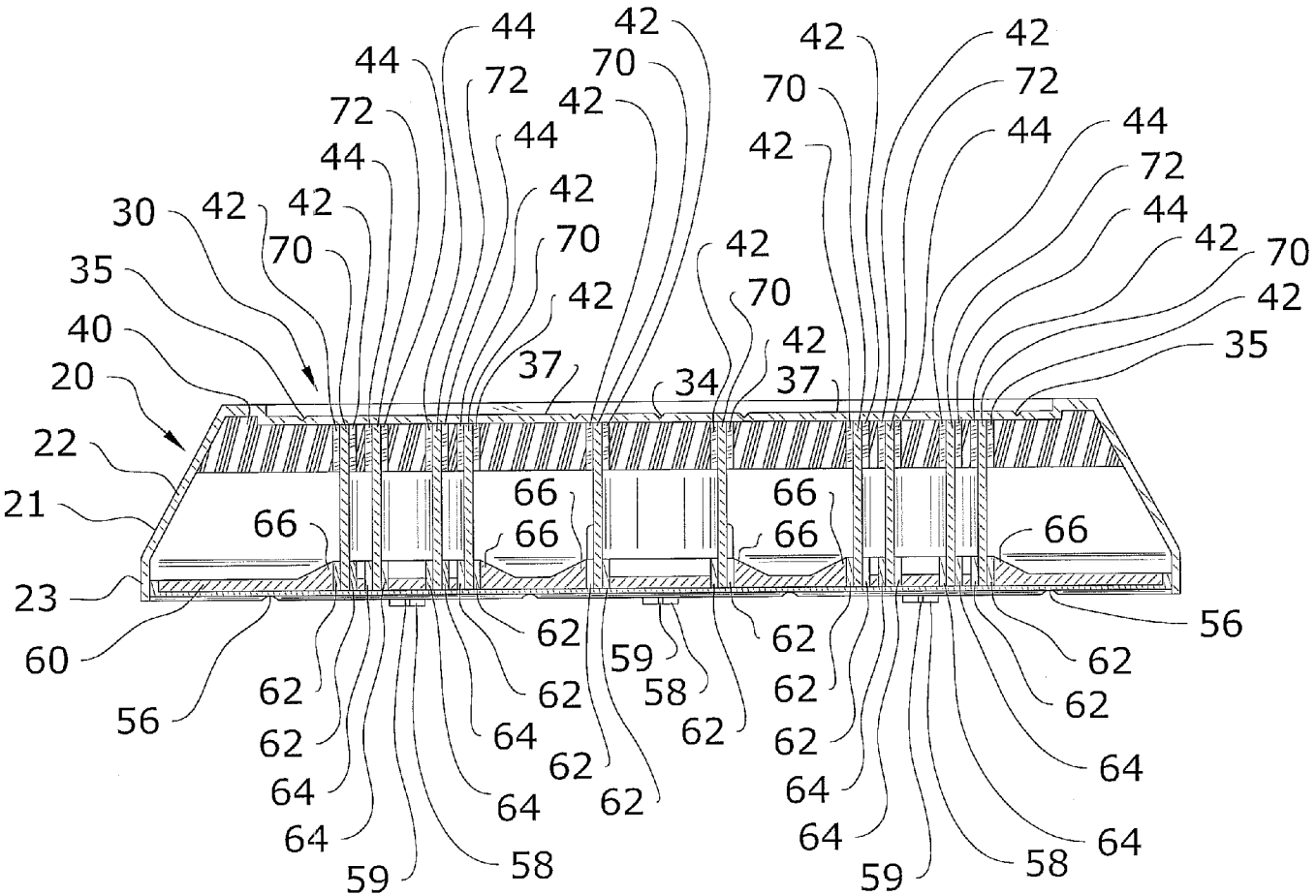
FIG. 4 is a lengthwise cross-sectional view of the present invention.
Figure 5:
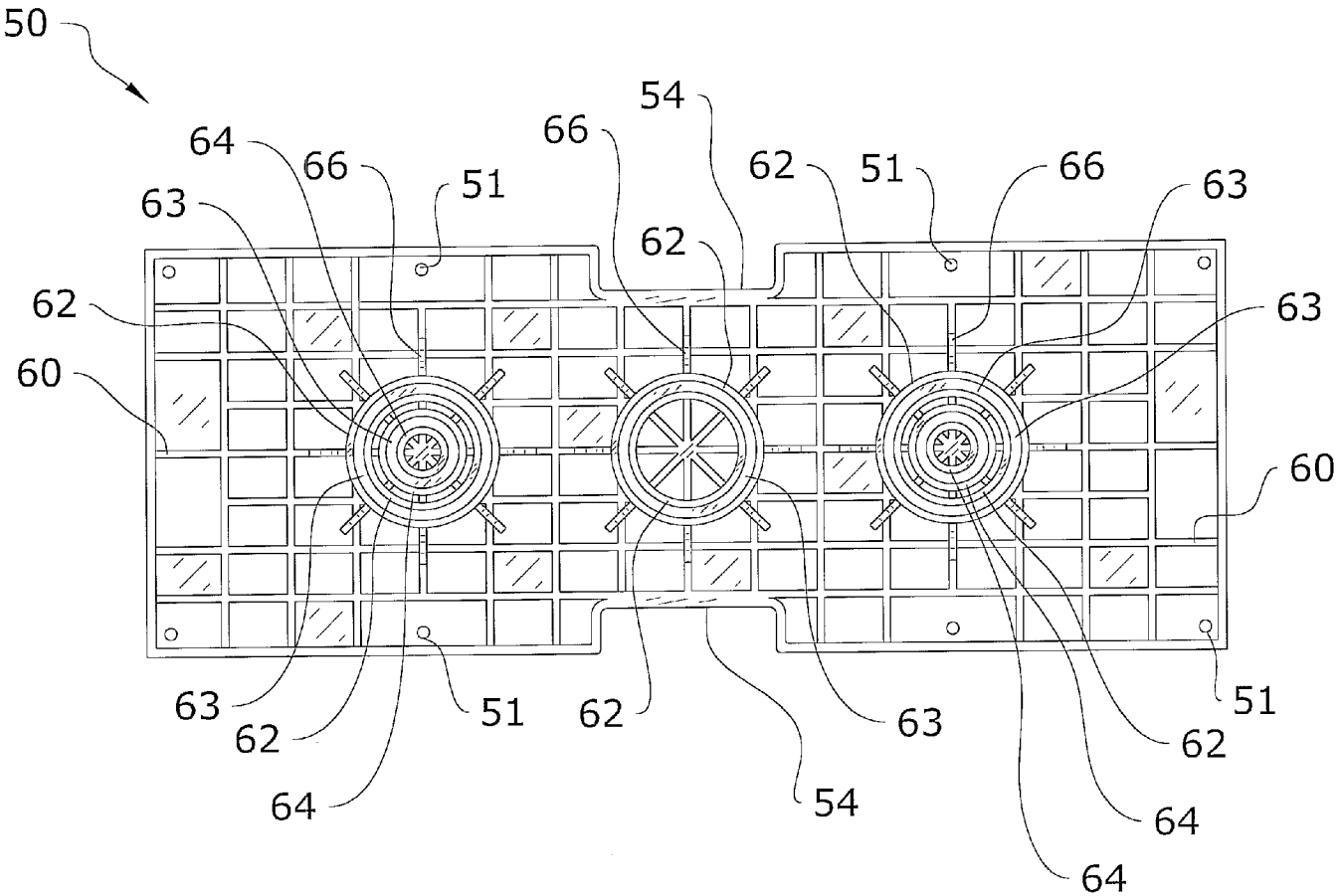
FIG. 5 is a top view of the base plate.
Figure 6:
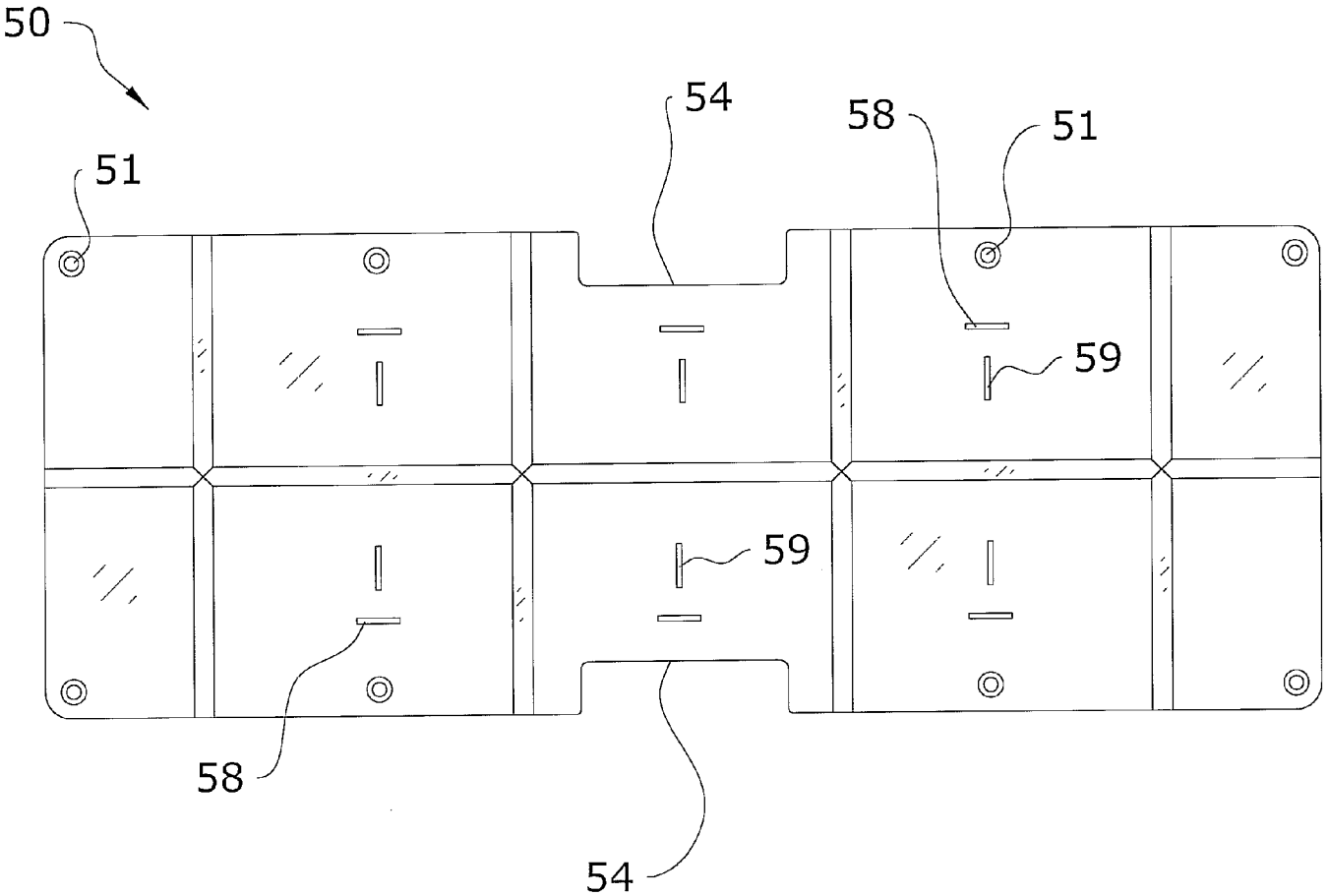
FIG. 6 is a bottom view of the base plate.
Figure 7:
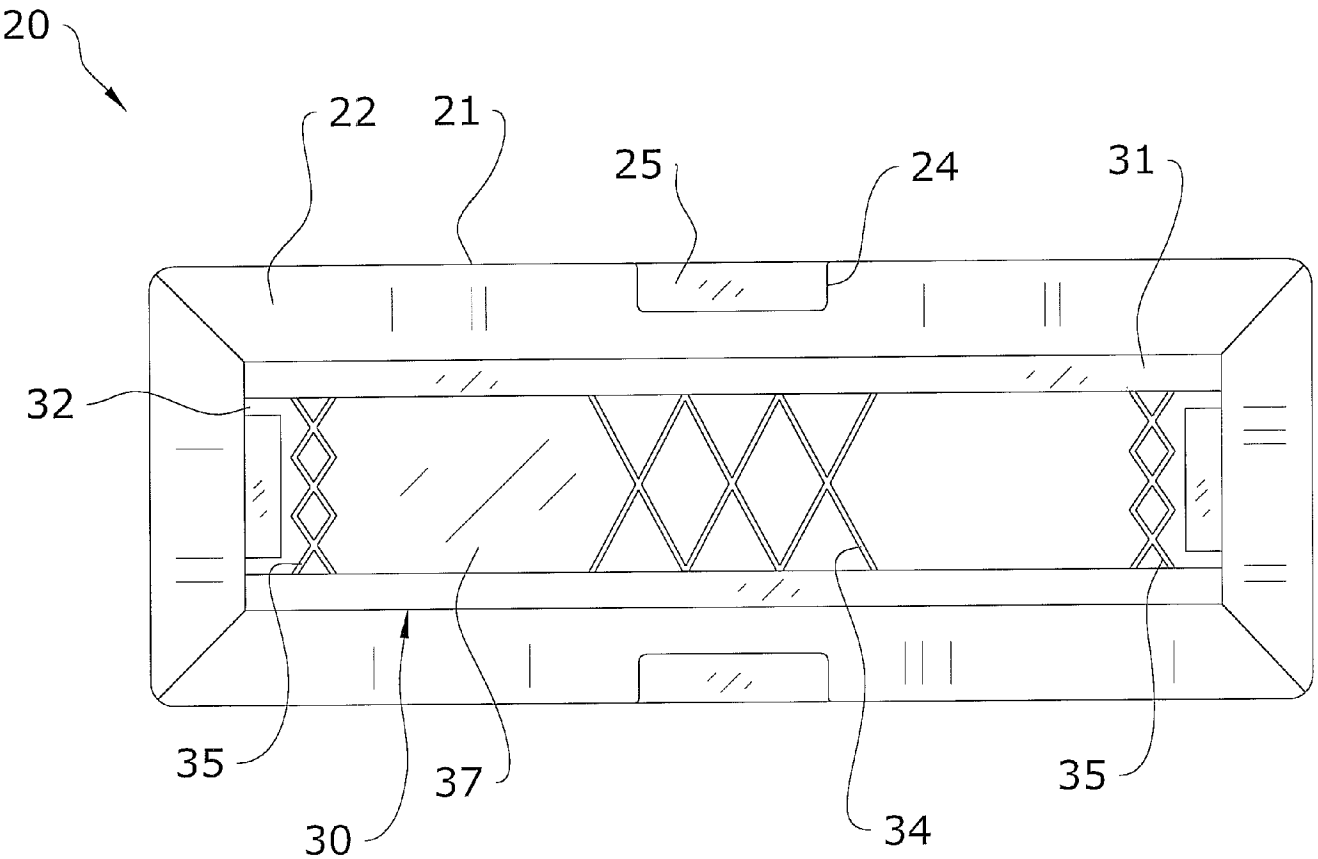
FIG. 7 is a top view of the support pad.
Figure 8:
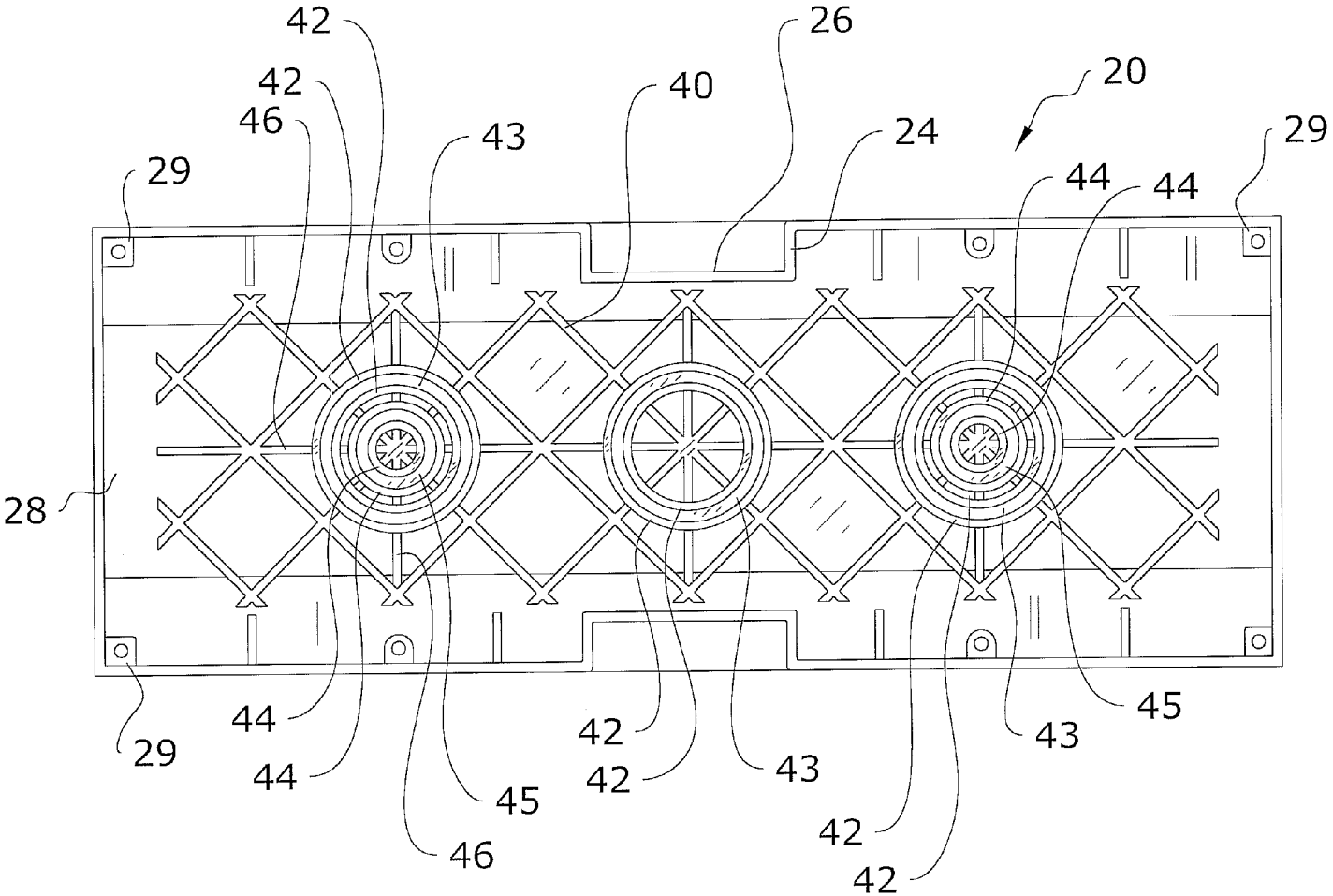
FIG. 8 is a bottom view of the support pad.
Figure 9:
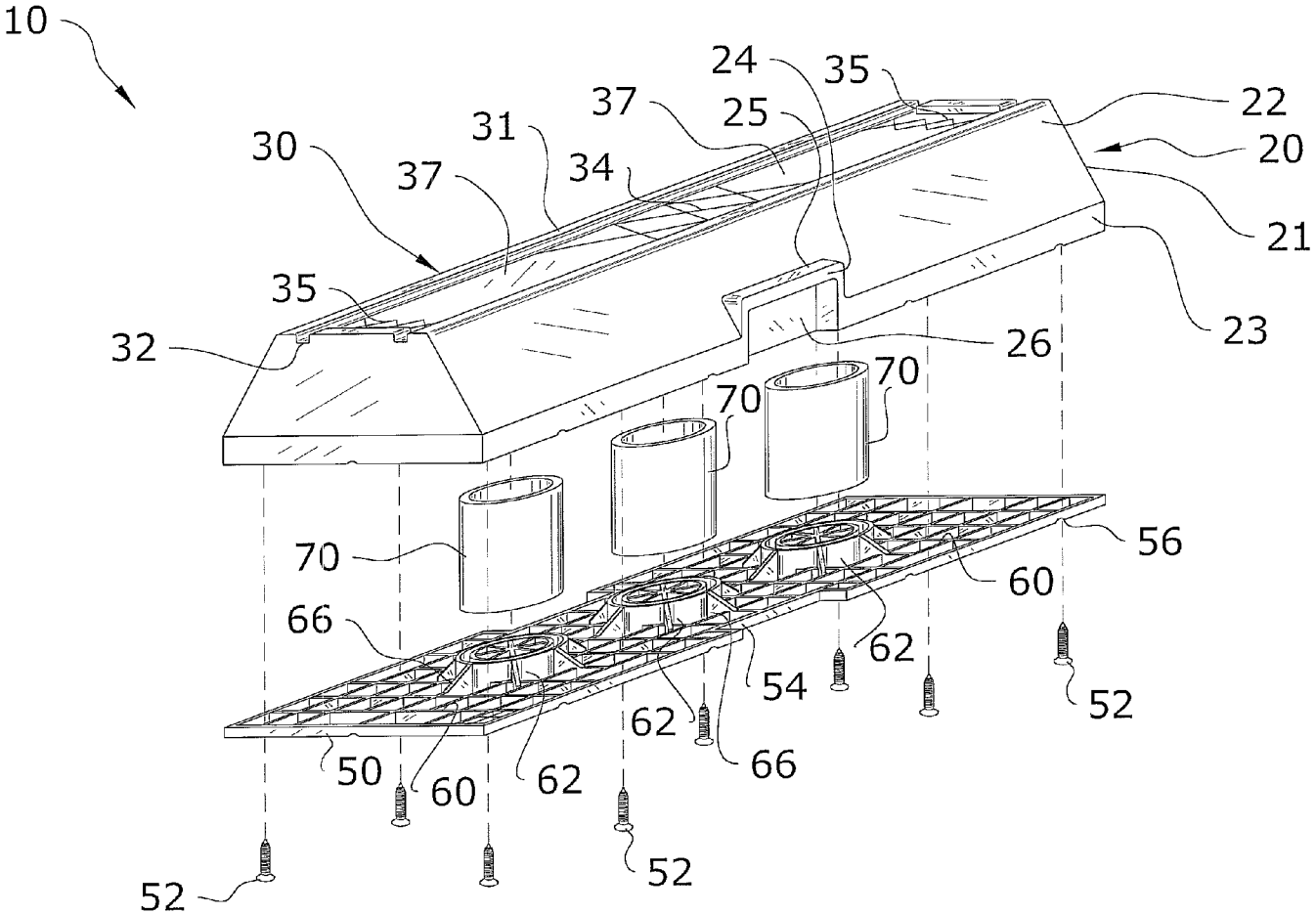
FIG. 9 is an exploded upper perspective view of an alternate embodiment of the present invention only including the outer internal supports.
Figure 10:
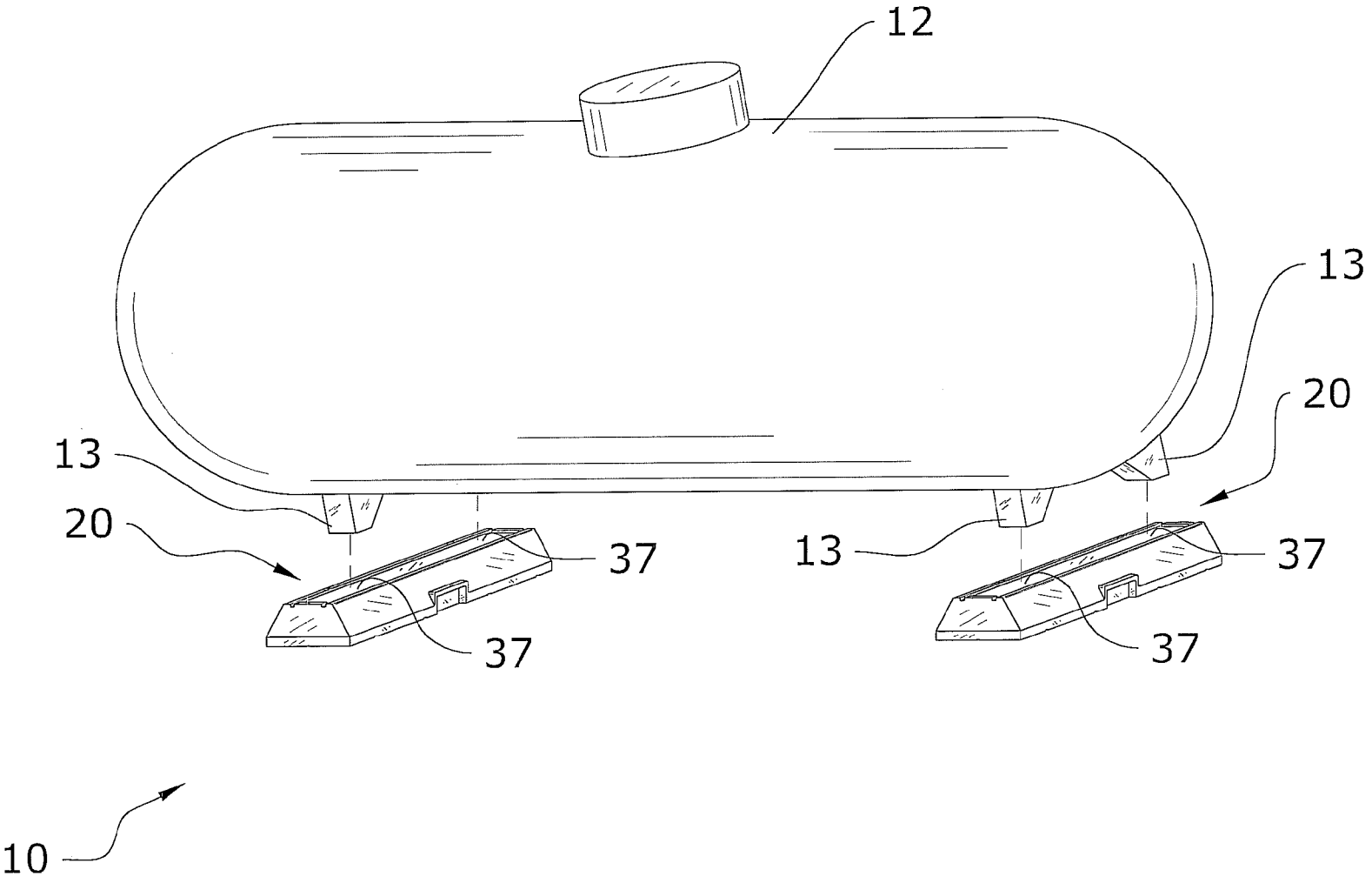
FIG. 10 is an upper perspective view of the present invention in use.

Turning now descriptively to the drawings, in which similar reference characters denote similar elements throughout the several views, FIGS. 1 through 10 illustrate a fuel tank support system 10, which comprises an elongated support pad 20 having a platform 30, a base plate 50 connected to the support pad 20, and a plurality of internal supports 70, 71 connected between the support pad 20 and the base plate 50. A plurality of pairs of upper retainer rings 42, 44 extends from an underside of the platform 30 to define upper receiver slots 43, 45, and a plurality of pairs of lower retainer rings 62, 64 extends from an upper side of the base plate 50 to define lower receiver slots 63, 65. An upper end of each of the internal supports 70, 71 is received by the upper receiver slots 43, 45 and a lower end of each of the internal supports 70, 71 is received by the lower receiver slots 63, 65. Handles 24, bottom grooves 56, and internal ribbing 40, 60 are also used with the tank support 10. The retainers 42, 44, 62, 64 generally employ a circular cross-section; however other shapes may be appreciated.

B. Support Pad

The support pad 20 is comprised of a rigid and elongated structure to support an end of a propane tank 12. The support pad 20 is preferably positioned under a pair of legs 13 on each end of the propane tank 12, wherein the present invention is preferably utilized with large horizontal propane tanks 12. The support pad 20 is also comprised of a strong material-structure to support the excessive weight of the propane tank 12, such as rigid plastic.

The support pad 20 is further comprised of a material that is substantially weatherproof so as to be left outside at all times and not wear away or corrode. In the preferred embodiment, the support pad 20 is comprised of a virgin plastic material and is molded to shape; however it is appreciated that the support pad 20 may be comprised of various materials and be constructed in various manners. The support pad 20 is further preferably comprised of a trapezoidal structure.

The support pad 20 includes sidewalls 21 each generally having a tapered portion 22 leading from the platform 30, and a lower rim 23 terminating the lower end of the sidewalls 21. The tapered portion 22 tapers outwardly from an upper end to a lower end. The lower rim 23 is generally vertically oriented, such as to be perpendicular with the platform 30, wherein a bottom edge of the lower rim 23 rests flat upon the ground surface and/or peripheral edge of the base plate 50. The total height of the sidewalls 21 is also such that when the propane tank 12 is positioned upon the platform 30, an individual is able to mow or trim under and around the propane tank 12 with ease and also paint and perform other maintenance to the lower end of the propane tank 12 with ease.

The support pad 20 also preferably includes a handle 24 protruding outwardly from each lateral sidewall 21 (along the lengthwise portion of the support pad 20) and more particularly from the tapered portion 22 of the sidewall 21. The handles 24 extend outwardly and a notch 26 is formed beneath the handles 24 for allowing grasping of the handles 24 from below. A top surface of the handles 24 may also be used as an identifier portion 25 for labeling ownership of the support blocks 10, propane tank 12, company name, etc. The identifier portion 25 is also adapted to be viewable when the support block 10 is in use. The identifier portion 25 also may receive and secure an identifier plate (i.e. nameplate).

The support pad 20 is also preferably comprised of a hollow structure to allow the present invention to be substantially lightweight so that the present invention may be easily transported, wherein an internal cavity 28 extends within the support pad 20 between the platform 30, sidewalls 21, and base plate 50. The internal cavity 28 preferably extends throughout the support pad 20. Various mounting tabs 29 may also extend inwardly from the sidewalls 21 within the internal cavity 28 for being received by fasteners 52 for securing the base plate 50. The mounting tabs 29 may have threaded apertures 51 or various other types of mounting structures.

The platform 30 extends across and along the longitudinal axis of the upper portion of the support pad 20. The platform 30 receives the legs 13 of the propane tank 12, wherein the platform 30 is preferably a sufficient length to receive a pair of legs 13 on a given end of the propane tank 12. The platform 30 is also preferably completely supported by the sidewalls 21, wherein the platform 30 does not extend beyond the tapered portion 22 of the sidewalls 21.

A raised edge 31 extends around the perimeter of the platform 30 to prevent the legs 13 from sliding off of the platform 30. The platform 30 is thus sunken with respect to the raised edge 31. The platform 30 is also preferably comprised of a substantially planar configuration to allow the legs 13 of the propane tank 12 to be positioned upon the platform 30 in a stable manner and to prevent the legs 13 from easily sliding or moving when positioned upon the platform 30. It is appreciated that the platform 30 may include drainage slots 32 extending through the corners or other portions of the raised edge 31 to allow water or liquid upon the platform 30 to drain off thereof past the raised edges 31.

The platform 30 also includes a plurality of raised or embedded guide ridges 34, 35. The guide ridges 34, 35 are preferably raised slightly from the platform 30 and serve as guides so that the legs 13 are evenly positioned upon the platform 30 with respect to a longitudinal axis of the platform 30 and so the legs 13 of the propane tank 12 are positioned upon the receiving portion 37 of the platform 30 that is supported by the internal supports 70, 71 within the internal cavity 28. The guide ridges 34, 35 preferably include at least one inner guide ridge 34 and a pair of outer guide ridges 35. It is appreciated however that the raised edge 31 may serve as the outer guide ridge 35.

In the preferred embodiment, the inner guide ridge 34 and the outer guide ridges 35 are comprised of a raised X-shaped configuration. It is appreciated that the platform 30 may include more or less guide ridges 34, 35 depending on the size and positioning of the legs 13 of the propane tank 12 upon the platform 30. The guide ridges 34, 35 may also include various indicia for warning purposes.

The receiving portions 37 are positioned between the outer guide ridges 35 and the inner guide ridge 34 upon opposing sides of the inner guide ridge 34. The receiving portions 37 are large enough in surface area to individually receive a respective leg 13 of the propane tank 12. The receiving portions 37 are further integral with the platform 30 and comprised of a planar configuration to flatly receive the legs 13 of the propane tank 12.

C. Base Plate

The base plate 50 is preferably removably connected to the support pad 20 and is generally comprised of a substantially planar structure and a similar material as the support pad 20. The base plate 50 forms the bottom of the support pad 20 to prevent dirt or other material from entering within the internal cavity 28 and also to better distribute the weight of the propane tank 12 over the entire surface area of the base plate 50.

The base plate 50 is preferably removable to allow for easier manufacture of the present invention and also to allow access to the internal cavity 28. It is appreciated however that the base plate 50 may be integrally formed with the support pad 20 in alternate configurations of the present invention.

The base plate 50 includes a plurality of apertures 51 extending through the base plate 50 and following a peripheral edge of the base plate 50. The apertures 51 preferably align with the openings of the mounting tab 29, wherein the apertures 51 and the mounting tab 29 preferably threadably receive a fastener 52 (e.g. screws) to secure the base plate 50 to the support pad 20.

The lower surface of the base plate 50 is preferably flush with the lower end of the lower rim 23 of the sidewalls 21 of the support pad 20. The base plate 50 also generally includes a notch 54 on each lateral side (along a lengthwise side) which aligns with the notch 26 of the support pad 20 and the handle 24 of the support pad 20 to allow sufficient space for a user to grasp when accessing the handles 24.

The bottom surface of the base plate 50 may also include a plurality of grooves 56 for conformity to ground surfaces, drainage, and/or to align with the internal lower ribbing 60. The grooves 56 also prevent the base plate 50 from sliding in the dirt or ground surface when the propane tanks 12 are positioned upon the platform 30 and allow the base plate 50 and support block 10 to break away from the soil when trying to lift the support block 10 from the dirt or ground surface.

The base plate 50 may include a plurality of first tabs 58 oriented parallel with a longitudinal axis of the base plate 50 and spaced apart. The base plate 50 may include a plurality of second tabs 59 oriented perpendicular with the longitudinal axis of the base plate 50 and spaced apart. The first tabs 58 and the second tabs 59 extend downwards from the bottom surface of the base plate 50 to engage the ground surface and maintain a separation with the ground surface and additionally grip the ground surface to prevent sliding of the base plate 50 and support block 10.

D. Internal Support Structure

An internal support structure is within the internal cavity 28 to provide support for the platform 30 of the support pad 20 when the propane tank 12 is positioned thereon. The internal support structure also serves to better distribute the weight from the propane tank 12 upon the platform 30. The internal support structure is designed to distribute the weight of the propane tank 12 to the outer ends of the support pad 20 to keep the center of the support pad 20 from bending or sagging. The internal support structure is preferably molded within the internal cavity 28 and is comprised of a durable and strong material so as to withstand large amounts of weight without deforming.

The internal support structure generally includes an upper ribbing 40 extending from the underside of the platform 30 and generally forming a criss-cross pattern. The present invention also generally includes a lower ribbing 60 extending from the upper side of the base plate 50 and forming a criss-cross pattern. Both the upper ribbing 40 and the lower ribbing 60 extend within the internal cavity 28.

The internal support structure also generally includes a plurality of outer retainer rings 42, generally formed in pairs to define a receiver slot 43 therebetween along the support pad 20. The receiver slot 43 and the retainer rings 42 are generally circular in shape. Each pair of retainer rings 42 are spaced apart so that the receiver slot 43 is an adequate width to removably receive the upper end of the respective internal support 70. Generally, a pair of retainer rings 42 and respective slot 43 are located beneath each receiving portion 37 and also below the inner guide ridges 34 thus providing optimal support for the platform 30.

The internal support structure also includes a plurality of outer retainer rings 62, generally formed in pairs to define a receiver slot 63 therebetween along the base plate 50. The receiver slot 63 and the retainer rings 62 of the base plate 50 are also generally circular in shape. Each pair of retainer rings 62 are spaced apart so that the receiver slot 63 is an adequate width to removably receive the lower end of the respective internal support 70. Generally, a pair of retainer rings 62 and respective slot 63 are located beneath each receiving portion 37 and also below the inner guide ridges 34 thus providing optimal support for the platform 30 thus aligning with the retainer rings 42 and receiver slots 43 along the underside of the platform 30 of the support pad 20.

The internal support structure may further include a plurality of inner retainer rings 44, 64 comprised of a smaller diameter than the outer retainer rings 42, 62 and preferably concentric with the outer retainer rings 42, 62 to receive internal supports 71. The inner retainer rings 44, 64 may be positioned centrally within each of the outer retainer rings 42, 62 or simply below the receiving portions 37 of the platform 30, where most of the support is needed. The inner retainer rings 44, 64, like the outer retainer rings 42, 62 each are circular in shape to form a circular shaped receiver slot 45, 65 between pairs of retainer rings 44, 64 and are located upon both the support pad 20 and the base plate 50.

The internal supports 70, 71 are preferably removably received within the upper receiver slots 43, 45 and the lower receiver slots 63, 65 upon opposing ends of the internal supports 70, 71. It is appreciated that in alternate embodiments, the internal supports 70, 71 may be fixed within the receiver slots 43, 45, 63, 65. In the preferred embodiment, the present invention includes first internal supports 70 to be received within the outer receiver slots 43, 63 and second internal supports 71 to be received and retained within the inner receiver slots 45, 65.

The second internal supports 71 are generally positioned within the first internal supports 70 and are concentric with the first internal supports 70. Both the second internal supports 71 and the first internal supports 70 preferably employ a circular cross-sectional shape and are comprised of a cylindrical piping structure. Various support tabs 46, 66 may extend from the retainer rings 42, 44, 62, 64 for support and stabilization thereof.

E. Operation of Preferred Embodiment

In use, the present invention is first assembled by attaching the base plate 50 to the support pad 20 and inserting the upper ends of the internal supports 70, 71 within the upper receiver slots 43, 45 and the lower ends of the internal supports 70, 71 within the lower receiver slots 63, 65. Two of the support blocks 10 are now positioned parallel with each other and at a distance from each other equal to the distance between opposing end legs 13 of the propane tank 12 to be utilized. The support blocks 10 are ensured to be stabilized upon the ground.

The propane tank 12 is now positioned upon the platforms 30 of the support blocks 10 by positioning the legs 13 of the propane tank 12 within a respective receiving portion 37 of a respective platform 30. Each support block 10 is now able to distribute the weight of the propane tank 12 among the internal support structure and by the internal supports 70, 71. It is appreciated that the owner may also mark their respective support pad 20 upon the identifier portion 25.

Unless otherwise defined, all technical and scientific terms used herein have the same meaning as commonly understood by one of ordinary skill in the art to which this invention belongs. Although methods and materials similar to or equivalent to those described herein can be used in the practice or testing of the present invention, suitable methods and materials are described above. All publications, patent applications, patents, and other references mentioned herein are incorporated by reference in their entirety to the extent allowed by applicable law and regulations. In case of conflict, the present specification, including definitions, will control. The present invention may be embodied in other specific forms without departing from the spirit or essential attributes thereof, and it is therefore desired that the present embodiment be considered in all respects as illustrative and not restrictive. Any headings utilized within the description are for convenience only and have no legal or limiting effect.

The invention claimed is:

1. A fuel tank support, comprising:

an elongated support pad having a platform defining at least a portion of an upper surface of said support pad;

wherein said support pad has a plurality of pairs of upper retainers extending from an underside of said platform within an internal cavity of said support pad, said plurality of pairs of upper retainers each being an integral portion of said support pad's underside;

a plurality of upper receiver slots defined by each of said pair of upper retainers, each of said pair of upper retainers being comprised of concentrically-aligned rings, wherein said plurality of upper receiver slots includes first upper receiver slots and second upper receiver slots, wherein at least a portion of said first upper receiver slots are concentric with said second upper receiver slots;

a base plate connected to said support pad, wherein said base plate substantially encloses said internal cavity;

wherein said base plate has a plurality of pairs of lower retainers extending from an upper side of said base plate within said internal cavity of said support pad;

wherein each said pair of lower retainers define a lower receiver slot; and a plurality of internal supports each having an upper end adapted to be received by one of said upper receiver slots and having a lower end adapted to be received by one of said lower receiver slots.

2. The fuel tank support of claim 1, wherein said plurality of internal supports have a circular cross-section.

3. The fuel tank support of claim 1, wherein said plurality of internal supports include a plurality of first internal supports surrounding a plurality of second internal supports.

4. The fuel tank support of claim 3, wherein said plurality of first internal supports are concentric with said plurality of second internal supports.

5. The fuel tank support of claim 1, including a pair of handles extending from a pair of sidewalls of said support pad.

6. The fuel tank support of claim 5, wherein said pair of sidewalls has a pair of notches formed beneath said pair of handles.

7. The fuel tank support of claim 6, wherein said base plate has a pair of notches aligned with said pair of notches of said pair of sidewalls.

8. The fuel tank support of claim 1, wherein said base plate has a plurality of grooves formed within a bottom surface.

9. The fuel tank support of claim 1, wherein said support pad has an upper ribbing structure along said underside of said platform.

10. The fuel tank support of claim 1, wherein said base plate has a lower ribbing structure along an upper side of said base plate.

11. A fuel tank support, comprising:

an elongated support pad having a platform defining at least a portion of an upper surface of said support pad;

wherein said support pad has a plurality of pairs of upper retainer rings extending from an underside of said support pad within an internal cavity of said support pad, said plurality of pairs of upper retainers each being an integral portion of said support pad's underside;

wherein said plurality of upper retainer rings includes a plurality of pairs of first retainer rings and a plurality of pairs of second retainer rings;

wherein each said pair of first retainer rings define a first upper receiver slot, each of said pair of first retainer rings being comprised of concentrically-aligned rings;

wherein each said pair of second retainer rings define a second upper receiver slot, each of said pair of second retainer rings being comprised of concentrically-aligned rings, wherein at least a portion of said first upper receiver slots are concentric with said second upper receiver slots;

a base plate connected to said support pad, wherein said base plate substantially encloses said internal cavity;

wherein said base plate has a plurality of pairs of lower retainer rings extending from an upper side of said base plate within said internal cavity of said support pad, said plurality of pairs of lower retainer rings each being an integral portion of said support pad's upper side;

wherein said plurality of lower retainer rings includes a plurality of pairs of first retainer rings and a plurality of pairs of second retainer rings;

wherein each said pair of first retainer rings define a first lower receiver slot;

wherein each said pair of second retainer rings define a second lower receiver slot;

a plurality of first internal supports each having an upper end adapted to be received by one of said first upper receiver slots and having a lower end adapted to be received by one of said first lower receiver slots; and a plurality of second internal supports each having an upper end adapted to be received by one of said second upper receiver slots and having a lower end adapted to be received by one of said second lower receiver slots.

12. The fuel tank support of claim 11, wherein said plurality of first internal supports have a circular cross-section.

13. The fuel tank support of claim 12, wherein said plurality of second internal supports have a circular cross-section.

14. The fuel tank support of claim 11, wherein said plurality of first internal supports are concentric with at least some of said plurality of second internal supports.

15. The fuel tank support of claim 11, including a pair of handles extending from a pair of sidewalls of said support pad.

16. The fuel tank support of claim 15, wherein said pair of sidewalls has a pair of notches formed beneath said pair of handles.

17. The fuel tank support of claim 16, wherein said base plate has a pair of notches aligned with said pair of notches of said pair of sidewalls.

18. The fuel tank support of claim 11, wherein said base plate has a plurality of grooves formed within a bottom surface.

19. The fuel tank support of claim 11, wherein said support pad has an upper ribbing structure along said underside of said platform and wherein said base plate has a lower ribbing structure along an upper side of said base plate.

20. A fuel tank support, comprising:

an elongated support pad having a platform defining at least a portion of an upper surface of said support pad;

a pair of handles extending from a pair of sidewalls of said support pad;

wherein said pair of said sidewalls have a pair of notches formed beneath said pair of handles;

wherein said support pad has a plurality of pairs of upper retainer rings extending from an underside of said platform within an internal cavity of said support pad, said plurality of pairs of upper retainers each being an integral portion of the underside of said support pad;

wherein said plurality of upper retainer rings includes a plurality of pairs of first retainer rings and a plurality of pairs of second retainer rings;

wherein each said pair of first retainer rings define a first upper receiver slot, each of said pair of first retainer rings being comprised of concentrically-aligned rings;

wherein each said pair of second retainer rings define a second upper receiver slot, each of said pair of second retainer rings being comprised of concentrically-aligned rings;

wherein at least a portion of said first upper receiver slots are concentric with said second upper receiver slots;

wherein said first upper receiver slots and said second upper receiver slots employ a circular cross-section;

a base plate connected to said support pad, wherein said base plate substantially encloses said internal cavity;

wherein said base plate has a pair of notches aligned with said pair of notches of said pair of sidewalls;

wherein said base plate has a plurality of grooves extending within a bottom surface;

wherein said base plate has a plurality of pairs of lower retainer rings extending from an upper side of said base plate within said internal cavity of said support pad, said plurality of pairs of lower retainer rings each being an integral portion of said support pad's upper side;

wherein said plurality of lower retainer rings includes a plurality of pairs of first retainer rings and a plurality of pairs of second retainer rings;

wherein each said pair of first retainer rings define a first lower receiver slot;

wherein each said pair of second retainer rings define a second lower receiver slot;

wherein at least a portion of said first lower receiver slots are concentric with said second lower receiver slots;

wherein said first lower receiver slots and said second lower receiver slots employ a circular cross-section;

a plurality of first internal supports each having an upper end adapted to be received by one of said first upper receiver slots and having a lower end adapted to be received by one of said first lower receiver slots; and a plurality of second internal supports each having an upper end adapted to be received by one of said second upper receiver slots and having a lower end adapted to be received by one of said second lower receiver slots.

* * * * *